United States Patent [19]

Uchida

[11] 4,390,266

[45] Jun. 28, 1983

[54] EXPOSURE APPARATUS FOR ELECTRONIC DUPLICATOR

[75] Inventor: Kohachi Uchida, Sagamihara, Japan

[73] Assignee: Tokyo Shibaura Denki Kabushiki Kaisha, Kawasaki, Japan

[21] Appl. No.: 232,219

[22] Filed: Feb. 6, 1981

[30] Foreign Application Priority Data

Feb. 7, 1980 [JP] Japan ..... 55-13855

[51] Int. Cl.[3] ..... G03G 15/04

[52] U.S. Cl. ..... 355/14 E; 355/1; 355/14 D

[58] Field of Search ..... 355/1, 14 D, 14 E, 69

[56] References Cited

U.S. PATENT DOCUMENTS

| | | | |
|---|---|---|---|
| 3,232,201 | 2/1966 | Frank et al. . | |
| 4,097,904 | 6/1978 | Wada | 355/1 X |
| 4,124,294 | 11/1978 | Nakamura | 355/69 X |
| 4,128,329 | 12/1978 | Kawano | 355/14 D |
| 4,172,646 | 10/1979 | Matsumoto | 355/1 X |
| 4,200,391 | 4/1980 | Sakamoto et al. | 355/14 D X |
| 4,215,930 | 8/1980 | Miyakawa et al. | 355/14 E X |
| 4,239,374 | 12/1980 | Tatsumi et al. | 355/14 E |
| 4,304,486 | 12/1981 | Cormier et al. | 355/14 D |
| 4,327,990 | 5/1982 | Tago | 355/14 E X |

FOREIGN PATENT DOCUMENTS

| | | | |
|---|---|---|---|
| 54-99632 | 8/1979 | Japan | 355/14 E |
| 54-151450 | 11/1979 | Japan . | |

*Primary Examiner*—A. D. Pellinen
*Assistant Examiner*—Keith E. George
*Attorney, Agent, or Firm*—Cushman, Darby & Cushman

[57] ABSTRACT

An exposure apparatus for an electronic duplicator including a first light-receiving element for receiving light reflected by a reference reflector plate or by an original and a second light-receiving element for receiving light reflected from an image focusing point of a photosensitive medium. The doses of light received by these light-receiving elements are converted to voltage signals for comparison with a reference voltage level in a comparator. The output of the comparator is coupled through a control signal generator and a trigger pulse generator to a lamp driver for controlling the document illuminating lamp light intensity and is also coupled through the control signal generator and a transformer for controlling the bias voltage applied to a developing device.

4 Claims, 8 Drawing Figures

EXPOSURE APPARATUS FOR ELECTRONIC DUPLICATOR

BACKGROUND OF THE INVENTION

This invention relates to exposure apparatus for electronic duplicator which can control the exposure light dose according to the dose of light reflected by an original.

For automatically controlling the exposure light dose in an electronic duplicator, it has been well known in the art to vary the light dose of an illumination lamp or the bias voltage applied to a developer according to the detection of the dose of light reflected by an original illuminated from the illumination lamp. FIG. 1 shows a prior-art exposure apparatus for electronic duplicator of the type in which an original 2 is scanned by illumination light 6 from an illumination lamp 1 and light reflected from the original 2 is focused as a light image thereof through a focusing light-transmitting member 3 onto a photosensitive drum 4. In this apparatus, a light-receiving plate 5 is disposed in the light path between the focusing light-transmitting member 3 and photosensitive drum 4. As shown in FIG. 2 (PRIOR ART), light-receiving plate 5 has a number of light-receiving elements 7 arranged in a row. These light-receiving elements 7 detect the dose of light reflected by the original 2, and the exposure light dose or bias voltage applied to a developing device is varied according to the detected light dose to obtain automatic exposure.

However, the automatic exposure apparatus of the above construction, in which the light-receiving elements 7 are disposed in part of the light path, has a drawback in that a delay time is involved in the automatic exposure action. More particularly, it is the case that the exposure is ended before an exposure dose control signal obtained through the exposure light dose is fed back to the exposure lamp.

In some duplicators, an automatic exposure section is separately provided. Such an automatic exposure section, however, must include an exclusive illumination lamp and a reflector, so that it complicates the construction and increases the cost.

U.S. Pat. No. 3,232,201, Frank et al, Feb. 1, 1966, discloses a scanning system using optical fiber. However, this patent does not disclose any system where the exposure light dose is controlled according to light reflected by the original.

SUMMARY OF THE INVENTION

An object of the invention is to provide an exposure apparatus for electronic duplicator, which can eliminate the above drawback and permits an adequate photosensitive medium surface image to be formed through the transmission of a light image of an original to a desired position through an optical fiber member, detection of the transmitted light dose and comparison of the detected light dose with a reference value.

To achieve the above objects, the exposure apparatus for electronic duplicator according to the invention comprises an image focusing system for scanning the original with the illumination light from an exposure light source and transmitting light reflected by the original as a light image thereof to a photosensitive medium, an optical fiber means for transmitting the original light image to a desired position, a light-receiving means for detecting the dose of light transmitted through the optical fiber means before the exposure is made and producing a voltage signal corresponding to the detected light dose, a reference voltage generating circuit means for producing a reference voltage for comparison, a comparator circuit means for comparing the output voltage from the light-receiving means and the output voltage from the reference voltage generating circuit means and producing a signal according to the result of comparison, and a control means for controlling the light dose of the exposure light source according to the output signal from the comparator circuit means.

With the exposure apparatus for electronic duplicator according to the invention, the exposure light dose or bias voltage applied to a developing device can be controlled according to the density of the original image, so that it is possible to obtain an adequate photosensitive surface image. In addition, light reflected by the original can be transmitted through the optical fiber means to any desired position through the light image transfer path free from any interrupting object, so that it is possible to obtain ready layout and simplified construction.

Further, since the image focusing light source is also used for the automatic exposure, there is no need of providing any separate light source, so that the apparatus can be inexpensively provided.

Furthermore, the illumination light for the automatic exposure is obtained through an opening formed in a portion of a reflector for the image focusing light source, so that it is possible to reduce the installation space for the light source device.

Still further, by the provision of a second light receiving element for detecting the contamination of the photosensitive medium in addition to the construction mentioned above, an adequate photosensitive surface image can be obtained through the detection of the density of the original image and a change of the voltage applied to the photosensitive medium.

Moreover, by the provision of a reference reflector on the original support, calibration of the measured dose of light received by the light-receiving element can be made before the detection of light reflected by the original, so that it is possible to improve the precision of the light receiving element.

BRIEF DESCRIPTION OF THE DRAWINGS

The above and other objects and features of this invention will be more apparent from the following description taken in connection with the accompanying drawings, in which.

DETAILED DESCRIPTION OF THE PREFERRED EMBODIMENTS

Figure 1:
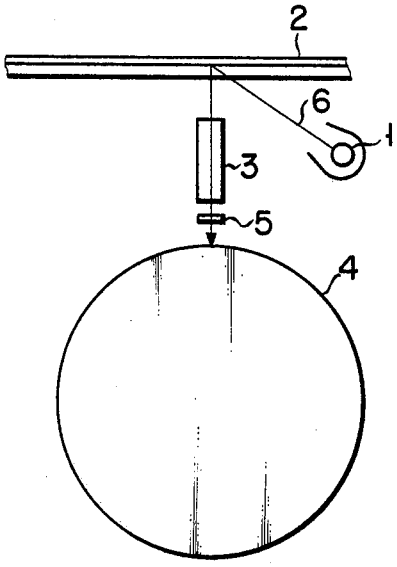
FIG. 1 (PRIOR ART)
FIG. 1 is a schematic view showing a prior-art exposure apparatus for electronic duplicator.
Figure 2:
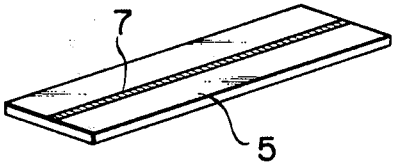
FIG. 2 (PRIOR ART)
FIG. 2 is a perspective view showing a light-receiving plate in the exposure apparatus shown in FIG. 1.
Figure 3:
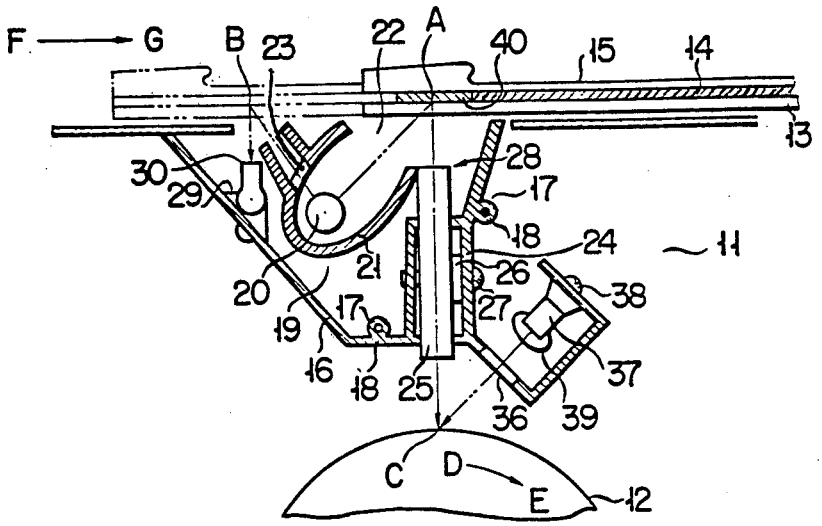
FIG. 3 is an elevational sectional view showing an embodiment of the exposure apparatus according to the invention.

FIG. 3 shows an exposure apparatus for electronic duplicator according to the invention.

Figure 4:
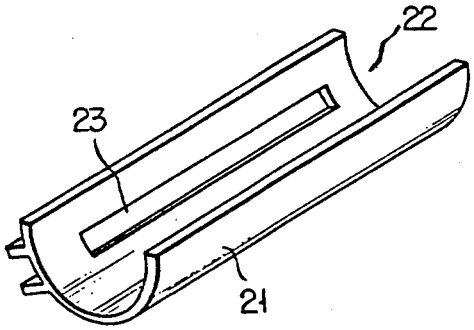
FIG. 4 is a perspective view showing a reflector in the exposure apparatus shown in FIG. 3.
Figure 5:
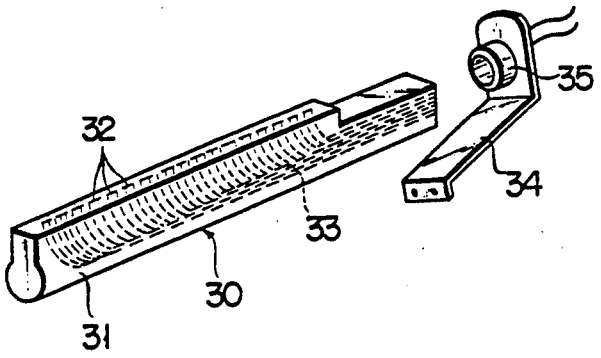
FIG. 5 is a perspective view showing an optical fiber member in the exposure apparatus shown in FIG. 3.

A photosensitive drum 12 rotating in the direction of arrow DE is provided within a frame 11. An original support 13 is reciprocably provided on top of the frame 11. An original document 14 is laid on the upper surface of the original support. The original support 13 is provided with a pivotable original cover 15 for keeping the original 14 in place. A case 16 is provided between the original support 13 and photosensitive drum 12. It is secured to a frame 19 by a screw 18 inserted in a mounting section 17 of it. A halogen lamp is provided as a light source 20 inside the case 16, and it is surrounded by a reflector 21. As shown in FIG. 4, the reflector 21 is provided with a first opening 22 and a second opening 23. Illumination light from the light source 20 reaches the original 14 through the first and second openings 22 and 23. The illumination light through the first opening 22 is incident on the original 14 at a scanning point A thereof, and the illumination light through the opening 23 is incident on the original at a scanning point B thereof. Both these light beams are reflected in a direction perpendicular to the original 14. The case 16 includes a light-transmitting member mounting section 24, which is found to correspond to the scanning point A, and a focusing light-transmitting member 25 is secured by a mounting screw 27 to the mounting section 24 via a buffering member 26. These component parts constitute an optical focusing system 28 for transmitting the light image from the original 14 and focusing it onto the photosensitive drum 12. The case 16 also includes an optical fiber member mounting section 29, which is found to correspond to the scanning point B, and an optical fiber member 30 is mounted in the mounting section 29. FIG. 5 shows the optical fiber member 30. As is shown, it includes optical fibers 32 having arranged at one end in a row along the top of their holder 31 and other end portions bundled and led to one end of the holder 31. A first light-receiving element 35 is provided on a bracket 34 to face the end of the optical fiber bundle 33.

Figure 6:
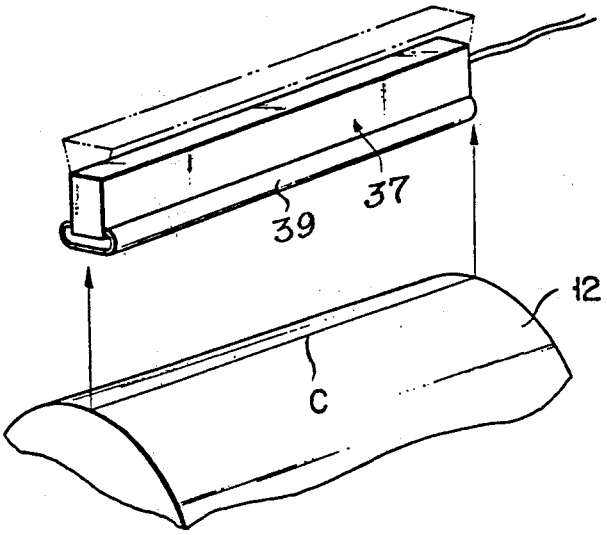
FIG. 6 is a perspective view showing a second light-receiving element in the exposure apparatus shown in FIG. 3.

Referring again to FIG. 3, a portion of the case 16 adjacent to the focusing light-transmitting member 25 is formed with an opening 36, and a second light-receiving element 37 for detecting light reflected from a focusing point C is disposed inside the case 16 to face the opening 36. The second light-receiving element 37 is secured by a screw 38 to the case 16, and a protective cover 39 is provided on its front face. FIG. 6 shows the second light-receiving element 37 in detail. Light reflected from a reference reflector 40 (shown in FIG. 3), which is integral with the original support 30, is focused on the photosensitive drum 2, and light reflected from the focusing point C is received by the second light-receiving element 37 for detecting a voltage level change due to contamination of the surface of the photosensitive drum 2.

Figure 7:
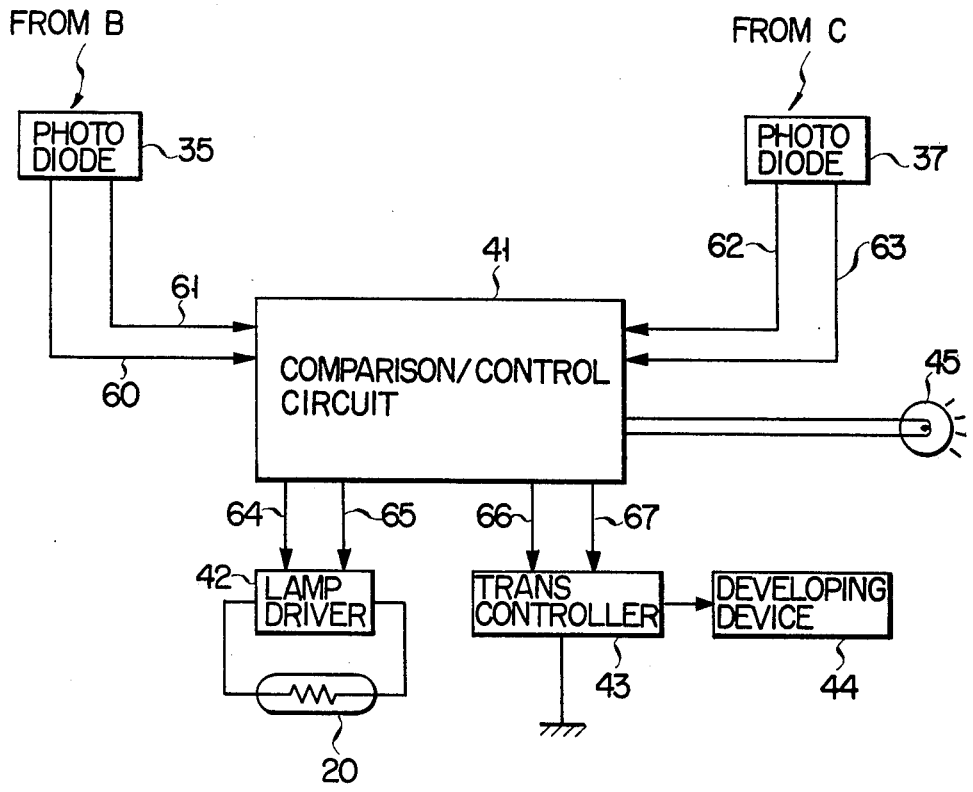
FIG. 7 is a block diagram showing a control circuit of the exposure apparatus shown in FIG. 3.

FIG. 7 shows a block diagram of a control circuit of the exposure apparatus shown in FIG. 3. In the Figure, the outputs of the first and second light-receiving elements 35 and 37 are coupled through respective leads 60, 61 and 62, 63 to a comparison/control circuit 41. The comparison/control circuit 41 produces an output coupled through lines 64 and 65 to a lamp driver 42 and also produces an output coupled through lines 66 and 67 to a transformer controller 43. The lamp driver 42 controls the light dose provided by the exposure lamp 20 on the basis of a control signal from the comparison/control circuit 41. The transformer controller 43 is connected to a developing device 44 and controls the voltage applied thereto according to a control signal from the comparison/control circuit 41.

Figure 8:
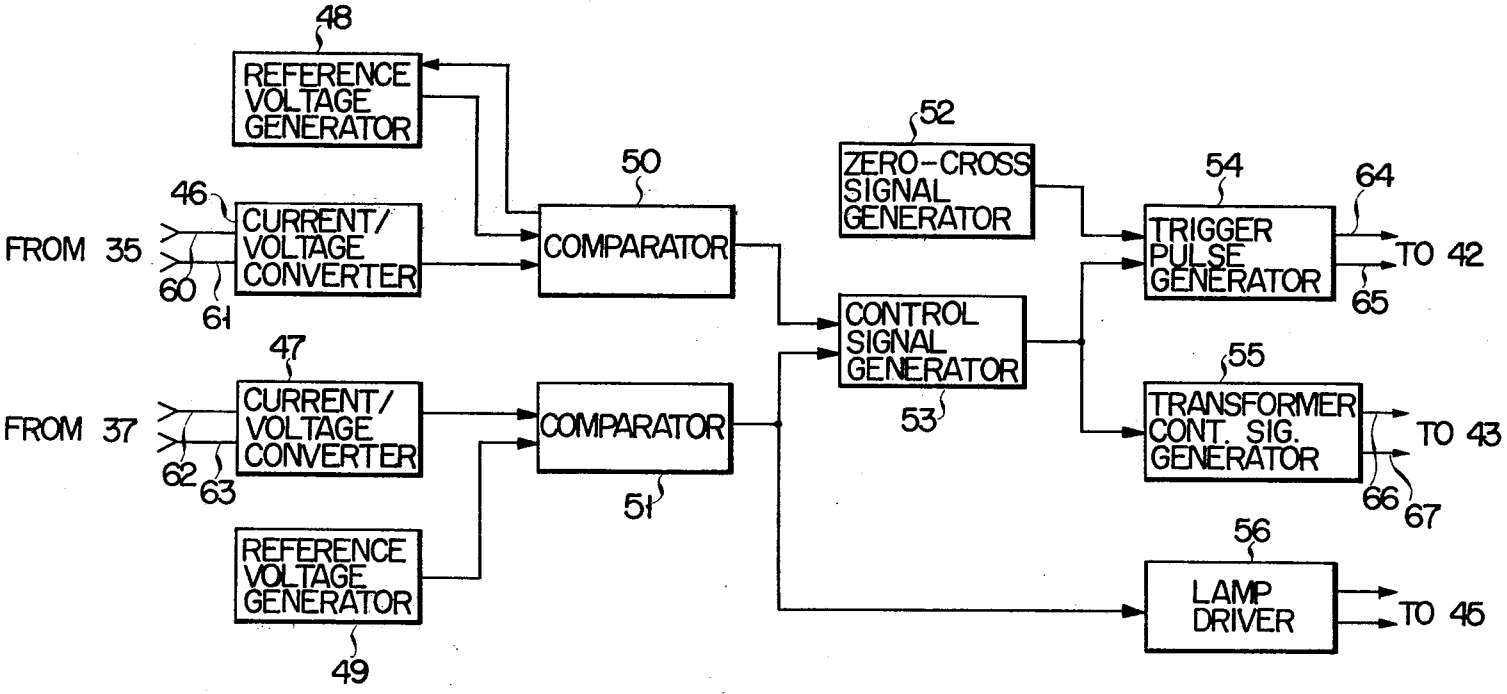
FIG. 8 is a block diagram showing the detailed construction of the control circuit shown in FIG. 7.

FIG. 8 shows a detailed block diagram of the comparison/control circuit 41 shown in FIG. 7. In the Figure, the outputs of the first and second light-receiving elements 35 and 37 are coupled to respective current/voltage converters 46 and 47, and the outputs of these converters 46 and 47 are coupled to respective first and second comparators 50 and 51 at one input terminal thereof. The outputs of first and second reference voltage generators 48 and 49 are coupled to the respective first and second comparators 50 and 51 at the other input terminal thereof. The outputs of these comparators 50 and 51 are coupled to a control signal generator 53, and the output thereof is coupled to a trigger pulse generator 54 and a transformer control signal generator 55. The output of a zero-cross signal generator 52 is coupled to the trigger pulse generator 54. The output of the comparator 51 is also coupled to a lamp driver 56. The output of the comparator 50 is also coupled to the input side of the aforementioned reference voltage generator 48, and it serves as a control signal for calibrating the reference voltage.

Now, the operation of the exposure apparatus having the above construction will be described. When copying the original 14 on the original support 13, the control circuit 41 functions to turn on the light source 20 and move the original support 13 in the direction of arrow FG. Illumination light from the light source 20 is incident on the scanning point A through the first opening 22 and on the scanning point B through the second opening 23. The original support 13 is moved at this time in the direction of arrow FG, i.e., from the side of the scanning point B to the side of the scanning point A. The illumination light is reflected by the reference reflector plate 40, and light reflected thereby is coupled through the optical fiber member 30 to the first light-receiving element 35. The first light-receiving element 35 converts the received light signal into an electric signal, which is coupled to the current/voltage converter 46. The current/voltage converter 46 converts the input electric signal into a voltage level signal which is coupled to the comparator 50 for comparison with a reference voltage signal from the reference voltage generator 48. The output of the comparator 50 produced as a result of comparison is fed back as a control signal to the reference voltage generator 48 for calibrating the reference voltage signal.

The original support 13, together with the original 14, passes by the scanning point B and proceeds to the scanning point A. As a result, the illumination light from the light source 20 is incident on the scanning point B through the second opening 23, and light reflected by said original 14 is incident on the optical fiber member 30. The reflected light incident on the optical fiber member 30 is coupled to the first light-receiving element 35. The light-receiving element 35 converts the input light signal into an electric signal which is coupled to the comparison/control circuit 41. In the comparison/control circuit 41, the input electric signal obtained through the photoelectric conversion of the light signal is converted to a voltage level signal through the current/voltage converter 46. This voltage level signal is coupled to the comparator 50 for comparison with the calibrated reference voltage signal coupled from the reference voltage generator 48. The output signal from the comparator 50 is coupled to the control signal generator 53. The control signal generator 53 couples a control signal produced as a result of comparison in the comparator 50 to the trigger pulse generator 54. Since a phase control signal from the zero-cross signal generator 52 is coupled as the other input to the trigger pulse generator 54, the trigger pulse generator 54 produces a pulse signal, which is coupled to the aforementioned lamp driver 42 for controlling the light dose provided by the exposure lamp 20. The control signal from the control signal generator 53 is also coupled to the transformer control signal generator 55. As a result, the transformer control signal generator 55 supplies a control signal to the transformer controller 43 shown in FIG. 7. The transformer controller 43 controls the bias voltage supplied for the development to the developing device according to the input control signal.

When the original 14 together with the original support 13 passes the scanning point B and reaches the scanning point A, the photosensitive drum 12 is exposed to the light image of the original focused on it through the focusing light-transmitting member 25 with exposure doses corresponding to the original image density.

When the reference reflector plate 40 moving with the original support 13 reaches the scanning point A, the illumination light from the light source 20 is reflected by the reference reflector plate 40 and focused on the photosensitive drum 12 through the focusing light-transmitting member 25, and the reflected light from the focusing point C is coupled through the opening 36 to the second light-receiving element 37.

The light signal received by the second light-receiving element 37 is converted in the current/voltage converter 47 into an electric signal which is coupled to the comparator 51. The comparator 51 compares this electric signal with a reference voltage signal coupled from the reference voltage generator 49, and its output signal is coupled to the control signal generator 53. The control signal generator 53 couples a control signal produced as a result of comparison in the comparator 51 to the trigger pulse generator 54. Since the phase control signal from the zero-cross signal generator 52 is coupled as the other input to the trigger pulse generator 54, the trigger pulse generator 54 produces a pulse signal, which is coupled to the aforementioned lamp driver 42 for controlling the light dose provided by the exposure lamp 20. The control signal from the control signal generator 53 is also coupled to the transformer control signal generator 55. As a result, the transformer control signal generator 55 supplies a control signal to the transformer controller 43 shown in FIG. 7. The transformer controller 43 controls the bias voltage supplied for the development to the developing device according to the input control signal. When the value compared in the comparators 50 and 51 exceeds the aforementioned reference voltage level, the lamp 45 is turned on through the lamp driver 56 to alarm this.

It is to be appreciated that by the provision of the first and second light-receiving elements 35 and 37 it is possible to obtain automatic exposure according to the original image density and the contamination of the surface of the photosensitive drum 12.

What is claimed is:

1. An image density detecting element for use in an image forming apparatus of the type in which an image exposure is achieved by illuminating a document and guiding light reflected therefrom to a photosensitive medium to form an image of the document thereon, comprising:

optical fiber light receiving means having a light-receiving surface of a size corresponding to an illuminated area of the document for receiving light reflected therefrom, said light receiving means comprising a plurality of optical fibers each having first and second ends, all of said first ends being aligned in a row along said light receiving surface, said second ends being gathered into a bundle that is substantially perpendicular to said light receiving surface; and light detecting means, optically coupled to said bundled second ends of said optical fibers for receiving light from each of said second ends and generating a single electrical signal related to the total light received from all of said second ends.

2. An image density detecting element according to claim 1 wherein said light detecting means comprises a photodiode.

3. An image density detecting element according to claim 1 wherein the size of said light receiving surface of said light receiving means corresponds to a portion of the document comprising its entire width.

4. An image density detecting element according to claim 1 wherein the length of said row corresponds to the width of the document.

* * * * *